United States Patent [19]

Kotaki et al.

[11] Patent Number: 4,897,273

[45] Date of Patent: Jan. 30, 1990

[54] PACKAGE WITH FRESHNESS KEEPING AGENT SACK

[75] Inventors: Kazutoshi Kotaki; Syuji Wakamatsu, both of Tokyo; Tadahiko Egawa, Mobara; Yoshikazu Morita; Kou Iwata, both of Tokyo, all of Japan

[73] Assignee: Mitsubishi Gas Chemical Co., Inc., Japan

[21] Appl. No.: 82,146

[22] Filed: Aug. 6, 1987

[30] Foreign Application Priority Data

Aug. 8, 1986 [JP] Japan ..... 61-121003
Apr. 10, 1987 [JP] Japan ..... 62-86945

[51] Int. Cl.[4] ..... B65D 81/24

[52] U.S. Cl. ..... 426/118; 426/124; 426/316; 426/326; 426/395; 426/410; 53/451; 53/474

[58] Field of Search ..... 426/124, 324, 325, 415, 426/112, 127, 410, 398, 316, 326, 395; 53/451, 410, 472, 474; 206/204, 205

[56] References Cited

U.S. PATENT DOCUMENTS

| | | | |
|---|---|---|---|
| 3,084,984 | 4/1963 | Adler | 426/127 |
| 3,255,020 | 6/1966 | Ferrell | 426/124 |
| 3,346,398 | 10/1967 | Tundermann et al. | 426/124 |
| 3,367,785 | 2/1968 | Finucane et al. | 426/112 |
| 3,419,400 | 12/1968 | Hayhurst et al. | 426/124 |
| 3,670,874 | 6/1972 | Brunner | 426/124 |
| 3,840,680 | 10/1974 | Schmidt et al. | 426/415 |
| 4,041,209 | 8/1977 | Scholle | 426/324 |

FOREIGN PATENT DOCUMENTS

| | | | |
|---|---|---|---|
| 55-135542 | 10/1980 | Japan | 426/324 |

*Primary Examiner*—Steven Weinstein
*Attorney, Agent, or Firm*—Leydig, Voit & Mayer

[57] ABSTRACT

A package of a food or a similar product which has to be preserved in fresh state. The package contains a sack charged with a freshness keeping agent for keeping the product fresh together with the product. The package comprises a carrier seat provided in the package and carrying the sack of freshness keeping agent fixed thereto, the seat having one end integrally heat-welded in one of the heat-sealed portions of the package and the other end integrally heat-welded in the other of the heat-sealed portions of the package. The carrier sheet is prepared by a process which has the steps of preparing a train of sacks in which a plurality of sacks, each containing the freshness keeping agent, are connected in series at least unidirectionally, feeding the train of sacks in one direction, feeding a continuous carrier sheet such that the carrier heat and the leading sack on the train of sacks are positioned one on the other, and attaching the leading sack on the train of sacks to the carrier sheet and severing, before or after the attaching, the leading sack from the remainder portion of the trains of sacks. Disclosed also is an apparatus suitable for producing this carrier sheet.

7 Claims, 5 Drawing Sheets

PACKAGE WITH FRESHNESS KEEPING AGENT SACK

BACKGROUND OF THE INVENTION (1) Field of the Invention

The present invention broadly relates to packages of a product such as foods which are to be preserved in fresh state, such as packages of confectionary, coffee beans, ground coffee, powdered milk, soybean flour, powders of cereals, beans, rice, rice cakes, hams, sausages and so forth. More particularly, the present invention is concerned with a method of and an apparatus for packaging a freshness keeping agent in a package together with a food to be preserved in fresh state.

(2) Description of the Related Art

Freshness keeping agents such as de-oxidizing agent and drying agent have been used for the purpose of preserving various foods in fresh state. Usually, these freshness keeping agents are charged in small sacks which are put in a package of a food to be preserved without being fixed to the package.

In the field of food industries, various problems have been encountered due to the fact that the sack of the freshness keeping agent is free within a food package. For instance, there is a risk for the purchaser to take the freshness keeping agent for the edible content and eat the agent. In the industrial processing of foods in which the packages of foods are handled automatically, there is a fear that the freshness keeping agent is dangerously mixed with the foods when the packages are opened. More specifically, in the automatic grinding of coffee beans, there is a possibility that the freshness keeping agent is inadvertently put into a grinder together with the coffee beans so as to be ground and mixed in the ground coffee. Similarly, in the case of automatic cooking of beans, there is a fear that the freshness keeping agent is cooked together with the beans so as to contaminate the cooked beans.

In order to avoid such accidents or troubles, it has been proposed to fix the sack of a freshness keeping agent to the package. For instance, attempts have been made to fix the sack of the freshness keeping agent to the sealing portion of a food package or to fix the sack to a suitable portion of the wall of the package or container by means of an adhesive. These attempts, however, are still unsatisfactory in that the work for fixing the sack is quite laborious and seriously impairs the efficiency of the packaging operation.

SUMMARY OF THE INVENTION

Accordingly, an object of the present invention is to provide a food package with a freshness keeping agent packaged therein together with a food to be preserved, which is improved to eliminate any risk for the purchaser from eating the freshness keeping agent, as well as troubles caused by accidental mixing of the freshness keeping agent in the food during handling of the food package.

Another object of the present invention is to provide a method of and an apparatus for producing a sheet to which is attached a sack of a freshness keeping agent, thereby making it possible for the first time to automatically produce food packages with sacks of freshness keeping agents fixed thereto.

To these ends, according to one aspect of the present invention, there is provided a package having at least two heat-sealed portions and containing therein a product to be preserved and a sack charged, with a freshness keeping agent for keeping the product fresh, said package comprising sheet means provided in the package for carrying the sack of freshness keeping agent fixed thereto, the sheet means having one end integrally heat-welded in one of the heat-sealed portions of the package and the other end integrally heat-welded in a second heat-sealed portion of the package.

According to another aspect of the present invention, there is provided a method of producing a carrier sheet carrying a plurality of sacks of a freshness keeping agent, the sack being intended to be put in a package of a product which is to be preserved, the method comprising: preparing a train of sacks in which a plurality of sacks, each containing the freshness keeping agent, are connected in series at least unidirectionally; feeding the train of sacks in one direction; feeding a continuous carrier sheet such that the carrier sheet and the leading sack on the train of sacks are positioned one on the other; attaching the leading sack on the train of sacks to the carrier sheet; and severing the leading sack from the remainder portion of the trains of sacks; whereby successive sacks are attached to the carrier sheet at a predetermined pitch along the length of the carrier sheet.

According to still another aspect of the invention, there is provided an apparatus for producing a carrier sheet carrying a plurality of sacks of a freshness keeping agent, the sack being intended to be put in a package of a product which is to be preserved, the apparatus comprising: feed rollers for continuously feeding a train of sacks in which a plurality of sacks each containing the freshness keeping agent are connected in series in at least one direction; attaching means for attaching by heat-welding the leading sack on the train of sacks onto a continuous carrier sheet which is fed separately from the train; and cutting means disposed between the feed rollers and the attaching means and adapted to sever the leading sack from the remainder portion of the train of sacks; the attaching means and the cutting means being operative such that the leading sack is attached by heat-welding onto the carrier sheet and severed from the train to become independent sack; whereby a continuous carrier sheet is obtained carrying a plurality of sacks of the freshness keeping agent attached thereto at a predetermined pitch.

BRIEF DESCRIPTION OF THE DRAWINGS

FIG. 3B is a schematic side elevational view of the piece of food package shown in FIG. 3A;

DETAILED DESCRIPTION OF THE PREFERRED EMBODIMENTS

Figure 1:
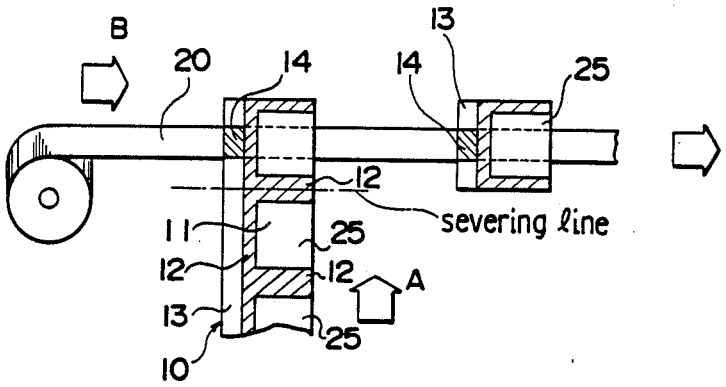
FIG. 1 is a schematic illustration of an embodiment of the method of the invention for preparing a sheet carrying a sack of a freshness keeping agent.

Referring first to FIG. 1, there is shown an embodiment of the method in accordance with the present invention for producing a web-like sheet carrying a sack of a freshness keeping agent, suitable for use in the manufacture of a food package having the sack of the freshness keeping agent fixed therein. A continuous train 10 of sacks 25 is adapted to be fed in the direction indicated by an arrow A. The sack train 10 has a plurality of sacks 25 containing a freshness keeping agent and connected in series in at least one direction. The sack train 10 is formed by folding a continuous single-layered or laminated sheet along a line which extends in the longitudinal direction of the sheet, placing the freshness keeping agent between two halves of the folded sheet at a predetermined interval in the longitudinal direction of the sheet, and heat-sealing three sides around each charged portion 11 where the freshness keeping agent is charged, as at 12. Thus, the consecutive sack portions 25 each charged with the freshness keeping agent are connected through heat-sealed portions 12. It will be seen that both longitudinal edges of the sack train are offset from each other in the transverse direction of the sack train 10 so as to provide a flap portion 13. Thus, a heat-weldable plastic film, which provides at least a portion of the inner surface of the package 10 contactable with the freshness keeping agent, is exposed at this flap portion 13. This arrangement is convenient in that the sack containing the freshness keeping agent can easily be adhered at this flap portion to a continuous sheet 20 which is fed in the direction of the arrow B.

As will be seen from FIG. 1, the leading one of the consecutive sack portions 25 is heat-welded at its flap portion 13 to the continuous sheet 20 and is severed from the sack train 10 along a severing line which resides in the heat-sealed portion 12 between the successive sack portions 25. After the severing, the sheet moves to the right as viewed in FIG. 1, so that the next sack portion 11 is placed on the continuous sheet 20. This sack portion 25 is heat-welded to the continuous sheet 20 and severed from the sack train 10 at the heat-sealed portion 12, in the same manner as that described above. This operation is continuously repeated so that independent sacks 25 of the freshness keeping agent are adhered to the continuous sheet 20.

The continuous sheet to which successive sacks 25 of the freshness keeping agent are adhered is delivered to another station which is in most cases a packaging machine.

Figures 2A, 2B:
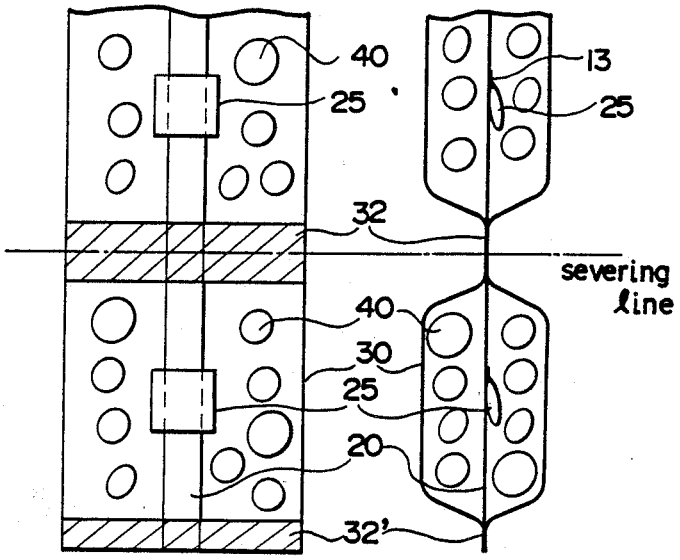
FIG. 2A is a schematic front elevational view of a food package produced from the sheet carrying a sack of a freshness keeping agent as prepared through the method illustrated in FIG. 1.
FIG. 2B is a schematic side elevational view of the food package shown in FIG. 2A.

FIGS. 2A and 2B illustrate an example of application of this continuous sheet 20 with sacks 25 of freshness keeping agent to packaging of a food. As will be seen from these Figures, the continuous sheet 20 carrying the sacks 25 is attached to a train of packaging containers 30 each accommodating a food 40 to be preserved, in such a manner that the continuous sheet 20 is sandwiched between both webs of the packaging container 30 and welded between the heat-seal regions 32 and 32' of the successive packaging containers 30. Then, the successive packaging containers 30 are severed one by one along severing lines 32 which may reside in the heat-seal regions 32, whereby packages of the food 40 with sacks of the freshness keeping agent fixed therein are obtained.

Figures 3A, 3B:
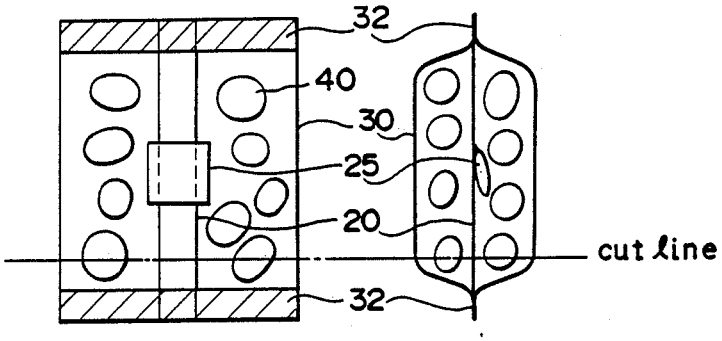
FIG. 3B is a schematic front elevational view of a piece of food package produced in the manner illustrated in FIGS. 2A and 2B.

One of the packages thus obtained is illustrated in FIGS. 3A and 3B.

Figures 4A, 4B:
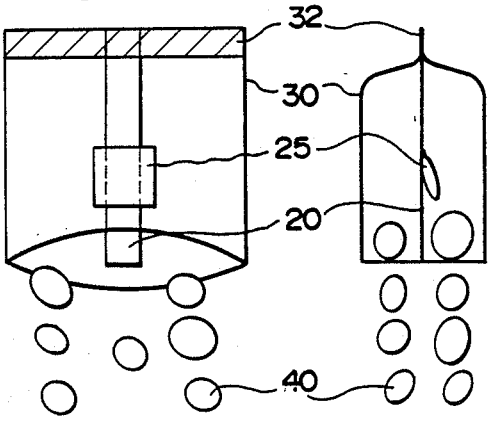
FIG. 4A is a schematic front elevational view of the food package shown in FIG. 3, opened by being cut along a cut line as shown in FIGS. 3A and 3B.
FIG. 4B is a schematic side elevational view of the food package shown in FIG. 4A.

FIGS. 4A and 4B illustrate the package which is opened by being cut or severing along a cut line shown in FIGS. 3A and 3B. It will be seen that the sack 25 of the freshness keeping agent is left in the container 30 even when the content 40, i.e., the food, is allowed to drop freely, by virtue of the use of the sheet 20 to which the sack 25 of the freshness keeping agent is adhered. It is thus possible to prevent the freshness keeping agent from being accidentally mixed in the food.

As will be understood from the foregoing description, the plastic sheet 20 carrying the sack 25 of the freshness keeping agent is integrated with the packaging container 30 as its one end is sandwiched between and heat-welded together with both webs of each packaging container 30 in one of the heat-sealed regions 32. It will also be understood that the other end of the sheet 20 is similarly sandwiched between and heat-welded together with both web portions in the other heat-sealed region 32.

From the view point of ease of the packaging operation, the continuous sheet 20 of plastic has a width which is not greater than the width of the packaging container 30. No restriction is posed on the width of the sheet 20 provided that the width is enough for securely holding the sacks 25 of the freshness keeping agent. For attaining a higher efficiency of the packaging process, however, it is preferred that the sheet 20 has the form of a continuous web or ribbon with a comparatively small width. It is also preferred that the intermediate portion of the sheet 20 in each package, i.e., the portion of the sheet 20 intermediate between both heat-sealed regions 32, is freed within the space in the packaging container 30 without being fixed to the wall of the packaging container 30.

Various methods are available for integrating the plastic sheet 20 carrying the sack 25 of freshness keeping agent with the packaging container 30. In the case where the packaging container is formed from a continuous tubular blank or from continuous sheets superposed and welded together along their longitudinal edges, the continuous sheet 20 carrying the sacks 25 of freshness keeping agent is laid to extend through such a tubular blank, and the tubular blank is heat-sealed at both sides of each of the successive sacks 25. In the case where the packaging container is of so-called three-side sealed type which is formed by folding a sheet and then heat-sealing three sides, the plastic sheet 20 carrying the sacks 25 of the freshness keeping agent is laid between both webs of the folded sheet of the container material and then conducting the heat-sealing operation at both sides of each of the consecutive sacks 25 and also at the longitudinal side of the container material sheet, so that the plastic sheet 20 is heat-welded between both webs of the packaging containers 30 at the heat-sealed regions 32 of the containers 30. In either case, packages of a food with a sack 25 of the freshness keeping agent fixed therein can be formed by placing the continuous plastic sheet 20 within the tubular container material, heat-sealing the container material at a required interval to form the train of the packaging containers 30, and then severing the train into independent pieces of package.

The continuous sheet 20 carrying the sacks 25 of the freshness keeping agent is preferably made from a heat-weldable thermoplastic resin film, particularly from a film of polyethylene, polypropylene or the like. When a specifically high strength is required, the continuous sheet 20 may have a laminated structure composed of a nylon or polyester film which is lined at its one or both sides with a film or films of a thermoplastic resin film.

When the freshness keeping agent is a de-oxidizing agent, the packaging container 30 is preferably made from a packaging material which is impermeable to gas. More specifically, in such a case, the packaging material used as the material of the packaging container 30 has oxygen permeability which is preferably not greater than 100 ml/m$^2$atmday, more preferably not greater than 20 ml/m$^2$atmday. Examples of such packaging material are: vinylidene chloride coat drawn nylon/-polyethylene, vinylidene chloride coat drawn polypropylene/polyethylene, vinylidene chloride coat drawn nylon/non-drawn polypropylene, vinylidene chloride coat drawn polypropylene/non-drawn polypropylene, polyethylene terephthalate/aluminum foil/-polyethylene, drawn nylon/aluminum foil/polyethylene, Bovlon (commercial name, produced by Nippon Gosei Kagaku Kabushiki Kaisha)/polyethylene, Bovlon/non-drawn polypropylene, Eval (commercial name, produced by Kuraray CO., LTD.)/polyethylene, and Eval/non-drawn polypropylene.

When the freshness keeping agent is an agent other than an de-oxidizing agent, the following packaging materials can be used as the material of the packaging container, besides the packaging materials listed above: drawn polypropylene/polyethylene, drawn polypropylene/non-drawn polypropylene, nylon/polyethylene, polyethylene alone, polystyrene alone, and so forth.

Figures 5A, 5B:
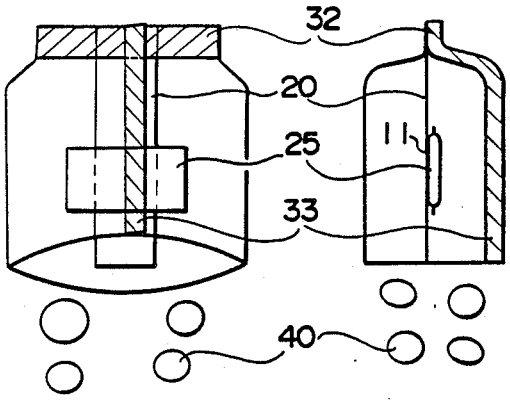
FIG. 5A is a view similar to FIG. 4A but showing a food package of a back-side seal type.
FIG. 5B is a schematic side elevational view of the food package shown in FIG. 5A.

The packaging container 30 is heat-sealed at at least two sides thereof. Thus, the packaging container may be of the types which are sealed at two, three or four sides thereof as shown in FIGS. 2 to 4, a three-side sealed type with a sealed back as shown in FIGS. 5A and 5B, a tube-type container, or a gussette type sack.

The freshness keeping agent may be a dehydrating agent, a carbon dioxide absorber, an ethylene absorbing agent and an alcohol generating agent, as well as a de-oxidizing agent used in the described embodiment. Obviously, one or more of these agents may be charged in a single sack.

Examples of the de-oxidizing composition are: compositions which contain sulfate, hydrogen sulfite, dithionite, hydroquinone, catechol, resorcin, pyrogallol, gallic acid, Rongalite, ascorbic acid and/or its salt, isoascorbic acid and/or its salt, sorbode, glucose, lignin, dibutyl hydroxytoluene or buthyl hydroxyanisole; compositions which contain ferrous salt such as ferrous sulfate; or compositions which contain powders of metals such as iron. It is also possible to use a de-oxidizing compositions of carbon dioxide generation type or of carbon dioxide absorption type.

According to the present invention, the fixing of each sack 25 containing a freshness keeping agent to the continuous sheet 20 of plastic is conducted by heat-welding them together by externally applying heat and pressure to the sack and sheet which are superposed on each other, by means of, for example, a heat sealer which is known per se. The heat-welding is conducted at a temperature which preferably ranges between 100 and 200° C., more preferably between 140°and 180° C.

The heat-welding is caused by heat-melting either one or both of the surfaces of the continuous plastic sheet 20 and the sack 25 of the freshness keeping agent. For the purpose of attaining a high efficiency in the packaging work, it is preferred that the sack 25 is welded at its heat-sealed portion 12 to the continuous sheet 20. When the edges of the folded webs constituting the sack are offset from each other so as to provide a flap portion as explained before, the sack 25 is fixed by being heat-welded to the continuous sheet 20 at the exposed heat-sealable surface of the flap portion 13 (see FIG. 1).

These fixing methods, however, are not exclusive and the arrangement may be such that each sack 25 of the freshness keeping agent is fixed to the sheet 20 at the charged portion 11 thereof, as shown in FIGS. 5A and 5B. In such a case, the sack may be fixed to the sheet by means of a double-sided adhesive tape. The packaging container 30 shown in FIGS. 5A and 5B is of so-called three-side sealed type which is sealed at three portions, namely, at an upper portion, a lower portion and a back portion.

An embodiment of the apparatus of the present invention for fabricating the described sheet carrying sacks of a freshness keeping agent will be described hereinunder with specific reference to FIG. 6.

Figure 6:
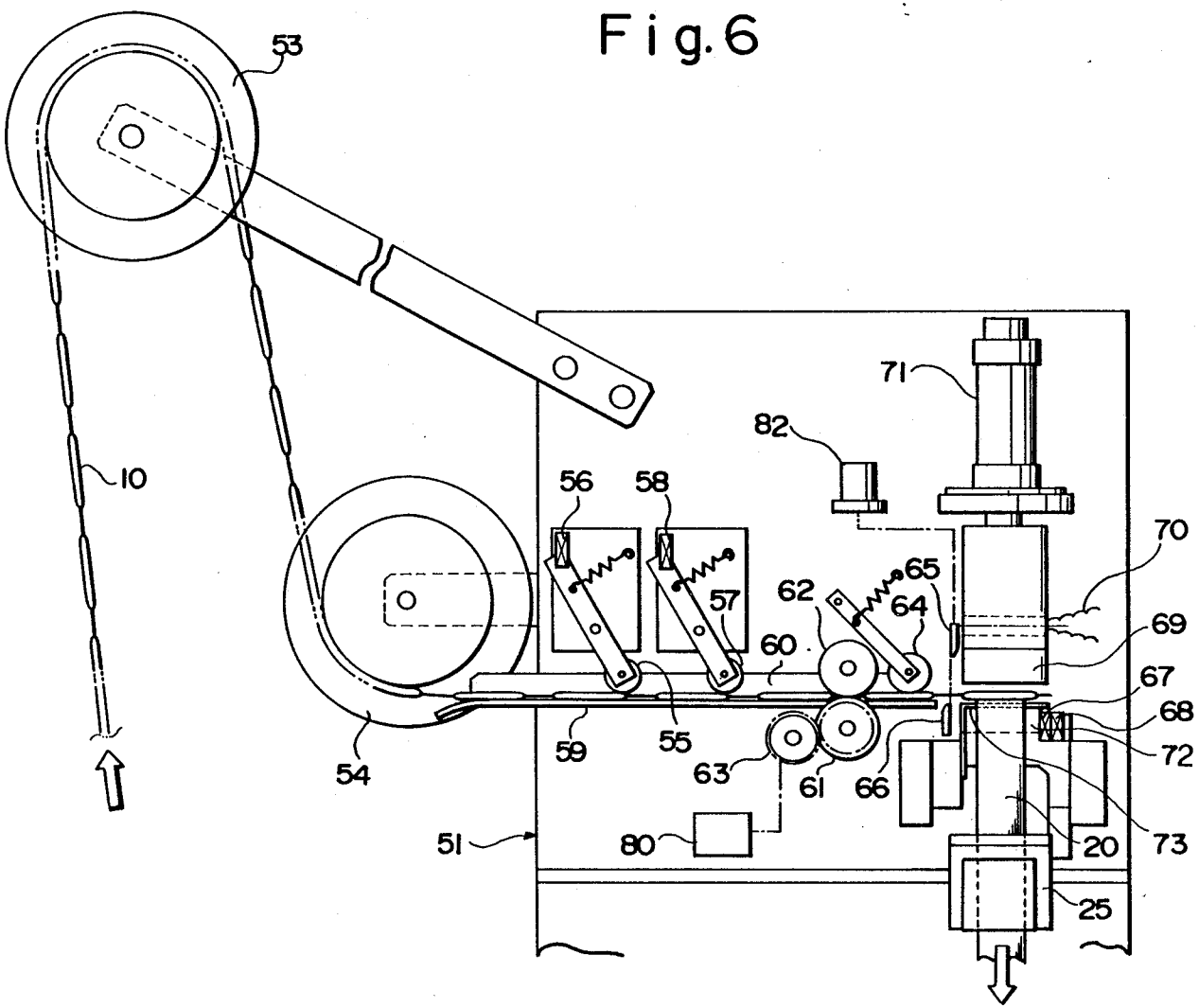
FIG. 6 is a front elevational view illustrating an embodiment of an apparatus of the present invention for producing a sheet carrying a sack of a freshness keeping agent.

Referring to FIG. 6, the apparatus for producing a sheet carrying sacks of a freshness keeping agent has a main body which is generally designated at a numeral 51. The main body 51 carries, through brackets, a pair of guide rollers 53 and 54 adapted for guiding a long train 10 of the sacks 25. One 53 of the guide rollers is disposed at a level higher than that of the other 54. Because of this height difference between both guide rollers 53 and 54, the content in each sack 25 is accumulated on the bottom portion in each sack so that the sacks can be fed while keeping a substantially regular thickness for an easy detection by a thickness detection roller 55 and thickness detector 56 which are adapted to detect, through sensing the thickness of the sack, passage of each of the successive sacks in the train 10. The apparatus also has another combination of a thickness detection roller 57 and a thickness detector 58. The roller 57 and the detector 58 constitute a safety mechanism which cooperate with a timer so as to stop the operation of the apparatus in the event of a mal-function. In place of the rollers 55 and 57 for the purpose of sensing the thickness of the sack, photoelectric-tube thickness detector can be used as well. A lower guide plate 59 and breadthwise guide bars 60 are laid along the path of the sack train 10 so as to guide the latter during movement in the region between the downstream side of the guide roller 54 and the upstream side of a cutter which will be mentioned later. A pair of feed rollers 61 and 62 adapted for feeding the sack train 10 are disposed on the downstream side of the thickness detection roller 57. At least one of the feed rollers 61 and 62 is power driven by a driving motor 63 which is adapted to operate in accordance with a signal derived from an external signal detector 80. A pressing roller 64 is disposed at the downstream side of the feed rollers 61, 62. At the downstream side of the pressing roller 64, there is disposed a cutter constituted by upper and lower cutter blades 65 and 66 which are adapted for cooperating with each other in severing successive sacks on the train 10 into independent sacks 25. The cutter is adapted to be actuated by a pneumatic cylinder 82. A reference numeral 67 designates a photoelectric-tube-type detector which is adapted for cooperating with the aforementioned thickness detecting roller in determining the timing of stopping of feed of the train 10 of sacks. Another photoelectric-tube-type detector 68 is provided for detecting any over-run of the sack train 10.

A pair of heat-sealer heads 69 and 72 are disposed downstream from the cutter blades 65, 66 such that they can clamp therebetween the leading sack on the sack train 10 and the continuous sheet 20 which is fed in a direction substantially orthogonal to the direction of feed of the sack train 10. One 69 of the heat sealer heads is adapted to be heated by an electric heater 70 and to be lowered towards the other heat sealer head 72 by means of a pneumatic cylinder 71 so that both heat sealer heads 69 and 72 cooperate with each other in heat-welding the sack 25 and the continuous sheet 20 to each other. The continuous sheet 20 is extracted from a roll (not shown) under the main body 51 of the apparatus into the region between the heat sealer heads 69 and 72 where the sack 25 is adhered in the manner explained before. The continuous plastic sheet 20 is then fed downward. A reference numeral 73 designates a guide plate. According to this arrangement, it is possible to adhere consecutive independent sacks 25 of the freshness keeping agent to the continuous sheet 20 at a predetermined interval along the length of the sheet 20, whereby a continuous sheet carrying sacks of freshness keeping agent is obtained.

The operation of the apparatus shown in FIG. 6 is as follows. In advance of the starting of the apparatus, a preparatory operation is conducted in which the continuous sack train 10 is set to go around the guide rollers 53, 54 and the leading end of the sack train 10 is made to pass through the nip between the feed rollers 61 and 62. Then, as a manual operation switch (not shown) is pressed, the driving motor 63 is started so that the sack train nipped between the feed rollers 61 and 62 is fed. The arrival of the leading sack 25 at a predetermined position between the heat sealer heads 69 and 72 is detected through cooperation between the thickness detection roller 55, thickness detector 56 and the photoelectric-tube-type detector 67 and the driving motor 63 is stopped in response to the detection. The continuous sheet 20 to which the sacks 25 are to be adhered has been laid beforehand through the region between the heat sealer heads 69 and 72. Then, as another manual switch (not shown) is operated, the pneumatic cylinder 71 is activated to lower the heat sealer head 69, thereby heat-welding the leading sack 25 to the continuous sheet 20. Then,. the pneumatic cylinder 82 connected to the cutter blade 65 is activated in response to a signal indicative of completion of the lowering of the heat sealer head 69, so as to sever the leading sack 25 from the sack train 10. The heater sealer head 69 is reset after elapse of a predetermined time or in response to a signal from a limit switch (not shown) adapted for detecting the arrival of the cutter blade 65 at the lower end of its stroke. The heat sealer head 69 therefore is stationed for the next sealing operation.

Although in the described embodiment a heat sealer having a pair of heat sealer heads is used as means for adhering the sack to the continuous sheet, it will be clear to those skilled in the art that any suitable means including a different type of heat sealing device can be used equally well for the purpose of welding the sack to the continuous sheet.

Preferably, the heat-welding of the sack to the continuous sheet is conducted at a heat-sealed portion of the sack. However, in the case where the sack has a flap portion 13 (see FIG. 1) formed by offsetting both edges of the webs of the sack from each other as explained before, the heat-welding may be conducted at the exposed heat-sealable surface of the flap portion.

The cutter is intended for severing successive sacks 25 of the freshness keeping agent from the train 10 of the sacks thereby to form independent sacks 25 of the freshness keeping agent. In the described embodiment, the cutter is disposed between the feed rollers and the heat-sealing portion and is so located that it can sever the leading sack 15 along the severing line which resides in the heat-sealed region between the leading sack 25 to be severed and the next sack. Thus, in the apparatus of the invention, it is desirable that the positions of the cutter and the position of the heat-sealer are determined in relation to each other such that when the single leading sack is positioned in the heat-sealing region where the heat sealer is positioned, the heat-sealed region of the sack train between the leading sack and the subsequent sack is positioned in the cutter. The arrangement may be such that the leading sack is first severed from the train by the cutter and then adhered to the continuous sheet by the operation of the heat sealer. However, in order to attain a higher stability and reliability, as well as higher efficiency, of the operation, the arrangement is preferably such that the leading sack is first introduced into the heat-welding region where the heat sealer is disposed so as to be heat-welded to the continuous sheet and is then severed from the sack train along the severing line which resides in the heat-sealed region between the sack to be severed and the subsequent sack.

The detection of the position of the severing line is preferably conducted by detecting the difference in the thickness between the charged portion 11 and the heat-sealed portion 12 of each sack. The detection, however, may be conducted by sensing the leading end of the sack by means of a photoelectric-tube -type detector. It is, however, most preferred that the detection be conducted by combined use of the thickness detector and the photoelectric-tube-type detector as in the described embodiment.

During the heat-welding and cutting operations, the feed of the sack train and the feed of the continuous sheet are temporarily stopped so as to allow the heat-sealer and the cutter to operate satisfactorily. After these operations are completed, the continuous sheet is fed by a distance corresponding to the pitch of the sacks, and the sack train also is fed by a distance corresponding to the length of one sack. The feed are again stopped so as to allow the sack to be heat-welded and severed. Thus, the intermittent feeds of the continuous sheet and the sack train and the heat-welding and severing operations are executed in a timed relation, preferably in response to signals from the thickness detector and/or the photoelectric-tube-type detector.

It will be obvious to those skilled in the art that the pneumatic cylinders 71 and 82 for actuating the heat-sealer and the cutter may be substituted by suitable other actuating means such as solenoid-type actuators or a mechanical actuators incorporating, for example, cams.

After the completion of the preparatory operation explained above, the leading end of the continuous sheet carrying the sacks is placed in a sealing section of a packaging machine which will be explained later, whereby the apparatus for producing continuous sheet carrying sacks of freshness keeping agent is operatively connected to the packaging machine. Then, as the packaging machine starts to operate, the sheet is extracted by the packaging machine from the above-mentioned apparatus by a length corresponding to the pitch of operation of the packaging machine. Once this condition is obtained, the operator changes the mode of operation of the apparatus into automatic mode, so that the series of operations including the heat-welding of the successive sacks onto the continuous sheet and the packaging of the sacks in the packaging container together with the content are conducted automatically.

More specifically, when the predetermined length of the continuous sheet carrying the sacks has been extracted from the apparatus, the packaging machine delivers to the external signal detector 80 of the apparatus a signal indicative of the completion of extraction of the sheet. In response to this signal, the driving motor 63 for driving the feed roller or rollers 61 and 62 is started thereby to feed the sack train 10 to bring the leading sack to a predetermined position. The arrival of the leading sack at the predetermined position is detected, as explained before, through the cooperation of the thickness detection roller 55, thickness detector 56 and the photoelectric-tube-type detector 67 on the end of the heat-welding portion.

Subsequently, the pneumatic cylinder 71 is activated to lower the heat sealer head 69 so that the leading sack is heat-welded at its heat-sealed portion or at the flap portion 13 (see FIG. 1) to the underlying continuous plastic sheet. When the heat sealer head 69 has completed its downward stroke, a signal is generated which triggers the operation of the pneumatic cylinder associated with the upper blade 65 of the cutter, whereby the leading sack is severed from the sack train 10 so as to become an independent sack 25 adhered to the continuous sheet 20. As in the case of the manual preparatory operation, the heat sealer head 69 reset to the initial position after elapse of a predetermined time or in response to a signal from a limit switch (not shown) which is capable of detecting the arrival of the cutter blade at its lower stroke end.

Figure 7:
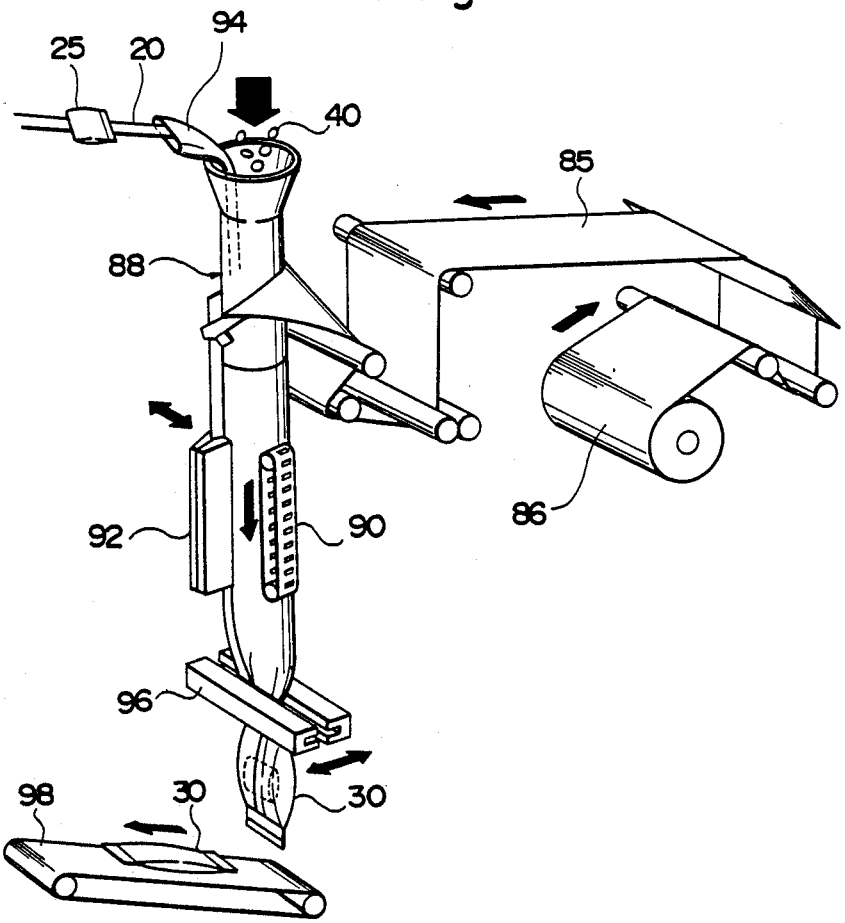
FIG. 7 is a schematic perspective view of a packaging apparatus in accordance with the present invention.

An example of the packaging machine is shown in FIG. 7. A film 85 as the material of the packaging container is supplied from a roll 86 into a container forming section 88 via a plurality of guide rollers. In the container forming section 88, the film is progressively rounded as it is fed by means of a vacuum belt 90 so as to bring its both side edges into overlapping relation. The thus overlapping side edges are welded together by a center sealer 92 so that a substantially tubular blank of the packaging container is formed. Meanwhile, the content 40 such as a food to be preserved is charged into the tubular blank of the packaging container from an upper end opening of the container forming section 88. At the same time, the continuous sheet 20 carrying sacks 25 of the freshness keeping agent also is successively fed into the tubular blank of the packaging container through a guide sleeve 94. Then, an end sealer/-cutter 96 intermittently operates to seal the tubular blank at a regular pitch so as to form successive container portions 30 charged with the content 40 and also with the sheet carrying the sack of the freshness keeping agent. The end sealer/cutter then cuts the continuous train of the container portions 30 so that the successive packaging container portions 30 are severed to become independent packages each containing the content 40 to be preserved and the sheet 20 carrying the sack 25 of the freshness keeping agent, the sheet 20 being fixed at its both opposite ends with both heat-sealed end portions of each package container 30. In FIG. 7, a reference numeral 98 designates a conveyor belt.

As will be understood from the foregoing description, according to the present invention, it is possible to consecutively attach a plurality of sacks of a freshness keeping agent to a continuous carrier sheet which is intended for fixing the sack of the freshness keeping agent to the inside of a package which contains a product to be preserved, e.g., a food. The attaching of the sacks of the freshness keeping agent is conducted precisely at a regular pitch along the length of the carrier sheet because the train of the sacks can be stopped exactly at the designated position.

The apparatus of the invention for producing the carrier sheet carrying the sacks of a freshness keeping agent is typically used in combination with a variety of packaging machine in a predetermined operational relationship therewith. Namely, the apparatus can operate in response to a signal given by an external equipment such as a packaging machine such that, in synchronism with the extraction of the finished carrier sheet by a predetermined length, the sack train is fed by a distance corresponding to one sack and stopped for heat-welding to the new portion of the carrier sheet.

It is also possible to arrange such that an alarm goes off in the event of a malfunction or an emergency so as to prevent any failure in the fixing of the sack of freshness keeping agent in the package and to avoid any inconvenience which may be caused in such an occasion, thereby ensuring safe functioning of the apparatus and also the safe operation of the packaging apparatus.

From the foregoing description, it will be understood that the present invention offers various advantages as follows.

Firstly, the present invention provides a novel and convenient method of producing a carrier sheet carrying sacks of a freshness keeping agent, as well as an apparatus which is suitable for use in carrying out such a method.

The carrier sheet carrying sacks of freshness keeping agent, produced by the method and apparatus of the invention, can suitably be applied to a food packaging process which requires charging of a sack of a freshness keeping agent together with the content in each package. In such a case, the carrier sheet carrying a sack in each package is secured at its both ends to the packaging container, so that the sack of the freshness keeping agent remains without fail in the packaging container regardless of which one of two sealed ends of the container is opened. In consequence, troubles encountered by the prior arts such as the risk for the purchaser to eat the freshness keeping agent and accidental mixing of the freshness keeping agent in the foods are avoided advantageously.

What is claimed is:

1. A package containing a product to be preserved and a sack of a freshness keeping agent, said sack and its contents being adapted to remove from the atmosphere in the package components that would diminish the product freshness, said package comprising opposed walls that are heat-sealed together at opposed ends of a first dimension of said package to define a product-containing space; and a sheet within the product-containing space extending between and integrally heat-sealed into, said opposed heat-sealed ends of the package but being otherwise unattached to the package walls, said sheet having a width that is less than the corresponding dimension of the package, and having the sack of freshness keeping agent attached thereto at a point remote from the heat-sealed ends of the sheet.

2. A package according to claim 1, wherein said sheet comprises a web-like sheet of a plastic.

3. A package according to claim 2, wherein said sheet comprises a heat-weldable thermoplastic resin film.

4. A package according to claim 3, wherein said sheet has a laminated structure composed of said heat-weldable thermoplastic resin film and at least one film of nylon or polyester formed on said heat-weldable thermoplastic resin.

5. A package according to claim 1, wherein said sack of freshness keeping agent is fixed to said sheet by means of an adhesive or by heat-welding.

6. A package according to claim 1, wherein said freshness keeping agent is an agent selected from the group consisting of a de-oxidizing agent, a dehydrating agent, a carbon dioxide absorbing agent, an ethylene absorbing agent, an alcohol generating agent and a mixture of two or more of said agents.

7. A package according to claim 1, wherein said freshness keeping agent is a de-oxidizing agent, and wherein said package is made from a material having an oxygen permeability of 100 $ml/m^2$ atmday or less.

* * * * *